US008960306B2

(12) United States Patent
Smith

(10) Patent No.: US 8,960,306 B2
(45) Date of Patent: Feb. 24, 2015

(54) ANNULAR BLOWOUT PREVENTER AND LOWER MARINE RISER PACKAGE CONNECTOR UNIT

(71) Applicant: Hydril USA Manufacturing LLC, Houston, TX (US)

(72) Inventor: Aaron P. Smith, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 115 days.

(21) Appl. No.: 13/725,100

(22) Filed: Dec. 21, 2012

(65) Prior Publication Data

US 2014/0174754 A1 Jun. 26, 2014

(51) Int. Cl.

| | |
|---|---|
| ***E21B 33/064*** | (2006.01) |
| ***E21B 33/035*** | (2006.01) |
| ***E21B 33/038*** | (2006.01) |
| ***E21B 17/10*** | (2006.01) |

(52) U.S. Cl.

CPC ..... *E21B 33/035* (2013.01); *E21B 33/038* (2013.01); *E21B 33/064* (2013.01); *E21B 17/1007* (2013.01)

USPC ..... 166/363; 166/338; 166/368; 251/1.2

(58) Field of Classification Search

CPC .... E21B 33/064; E21B 33/085; E21B 33/038

USPC ..... 166/367, 338, 360, 363, 368; 251/1.1, 251/1.2

See application file for complete search history.

(56) References Cited

U.S. PATENT DOCUMENTS

| | | | | |
|---|---|---|---|---|
| 3,321,217 | A * | 5/1967 | Ahlstone | 285/18 |
| 4,478,287 | A * | 10/1984 | Hynes et al. | 166/341 |
| 4,491,345 | A * | 1/1985 | Regan | 285/18 |
| 4,602,794 | A * | 7/1986 | Schaeper et al. | 277/327 |
| 4,902,044 | A * | 2/1990 | Williams et al. | 285/18 |
| 5,588,491 | A * | 12/1996 | Brugman et al. | 166/383 |
| 5,662,171 | A * | 9/1997 | Brugman et al. | 166/383 |
| 6,070,669 | A * | 6/2000 | Radi et al. | 166/368 |
| 6,227,300 | B1 * | 5/2001 | Cunningham et al. | 166/339 |
| 6,408,947 | B1 * | 6/2002 | Cunningham et al. | 166/339 |
| 6,715,554 | B1 * | 4/2004 | Cunningham et al. | 166/348 |
| 8,424,607 | B2 * | 4/2013 | Springett et al. | 166/298 |

OTHER PUBLICATIONS

Drawing of a Blowout Preventer and LMRP Connector—date of drawing is unkown.

* cited by examiner

*Primary Examiner* — Matthew Buck
(74) *Attorney, Agent, or Firm* — Bracewell & Giuliani LLP

(57) ABSTRACT

An annular blowout preventer assembly has an annular element housing and a central cavity with an elastomeric annular element in the central cavity. An annular element piston is located within the central cavity in engagement with the annular element. A connector housing has an upper end that abuts a lower end of the annular element housing. Bolts extend upward from the connector housing into threaded blind holes in the annular element housing for securing the connector housing to the annular element housing. A locking element is carried within the connector housing for radial inward movement into engagement with a profile on a mandrel of a blowout preventer stack.

11 Claims, 5 Drawing Sheets

ANNULAR BLOWOUT PREVENTER AND LOWER MARINE RISER PACKAGE CONNECTOR UNIT

FIELD OF THE INVENTION

This disclosure relates in general to offshore blowout preventer equipment for well drilling, and in particular to an annular blowout preventer and lower marine riser package connector unit.

BACKGROUND

A blowout preventer assembly is employed for offshore well drilling operations. The blowout preventer assembly includes a blowout preventer stack (BOP stack) that includes several ram preventers. The BOP stank lands on and corrects to a wellhead housing at the sea floor. A lower marine riser package (LMRP) connects to a tubular mandrel on the upper end of the BOP stack. The LMRP secures to a lower end of the riser and has control pods that control various functions of the BOP stack and LMRP. The LMRP also has one or more annular blowout preventers, which can seal around pipe of a variety of sizes as well as completely close the passage.

The LMRP has a connector that is hydraulically actuated and will releasably connect the LMRP to the mandrel of the BOP stack. The annular BOP is located directly above the LMRP and connected by an external bolted flange.

The LMRP and BOP stack are large pieces of equipment, quite tall. It would be desirable to reduce the overall height of the BOP assembly because of height restrictions when the equipment is stowed on the rig. A reduced height LMRP would allow the use of the equipment on rigs with a lower deck height. A reduced height LMRP would allow for smaller rig designs. It would also allow for the installation of an additional ram BOP preventer in the BOP stack without adding the full height of the additional ram to the assembled BOP stack and LMRP. A reduced height LMRP would also allow replacement of shorter height annular BOPs, if desired, for taller height annular BOPs.

SUMMARY

An annular blowout preventer assembly includes a single-piece annular element housing having a central cavity containing an elastomeric annular element and an annular element piston that strokes axially, relative to an axis of the annular element housing, to deform the annular element radially. The overall height of the annular blowout preventer assembly is reduced by employing a single-piece connector housing that abuts and is secured to a lower end of annular element housing. The connector housing contains a locking element and a locking element piston that axially strokes a cam ring to move the locking element radially inward into engagement with a mandrel of a blowout preventer stack. The overall height of the unit that makes of the annular BOP and LMRP connector is less than those employing an external bolted flange on the lower end of the annular BOP.

An axial distance from the lower end of the annular element housing to the central cavity is less than an axial distance from a lower end of the connector housing to the lower end of the annular element housing. A radial wall thickness of the annular element housing at any point from the central cavity to the lower end of the annular element housing is at least equal to the radial wall thickness of the annular element housing at the lower end of the annular element housing. The annular element housing has an exterior surface from the lower end to the central cavity that is free of any upward-facing surfaces. A maximum outer diameter of the connector housing is less than an outer diameter of the annular element housing at any point along the annular element housing.

An external flange on the connector housing defines an upward-facing surface and a downward-facing surface, the upward-facing surface of the external flange being in abutment with the lower end of the annular element housing. Bolts extends through holes provided in the external flange into threaded holes provided in the annular element housing. The bolts have heads that engage the downward-facing surface of the external flange.

DETAILED DESCRIPTION OF THE DISCLOSURE

Figure 1:
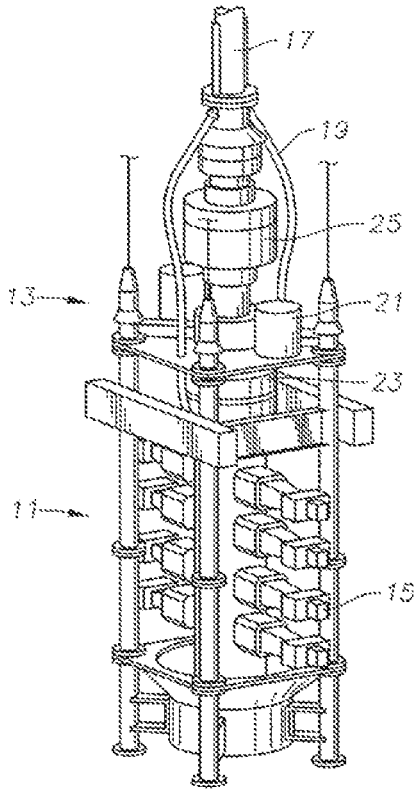
FIG. 1 (Prior Art)
FIG. 1 is a simplified perspective view of a prior art subsea blowout preventer assembly.

Referring to FIG. 1, a prior art subsea riser assembly includes a blowout preventer (BOP) stack 11 that connects to a subsea wellhead housing (not shown) at the upper end of a well being drilled. The assembly also includes a lower marine riser package (LMRP) 13 that connects to the upper end of BOP stack 11. BOP stack 11 has a number of ram preventers 15 for selectively closing the passage through BOP stack 11. Some of the ram preventers 15 will close around a string of pipe (not shown) extending through BOP stack 11. At least one other ram preventer 15 will shear the string of pipe and close the passage.

Figure 2:
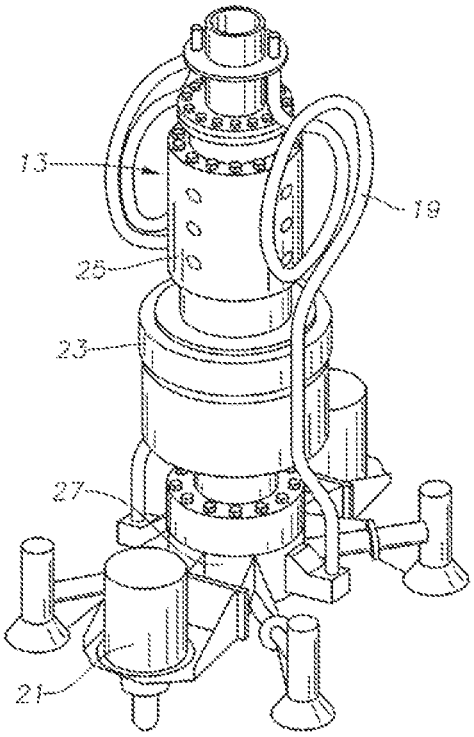
FIG. 2 (Prior Art)
FIG. 2 is a simplified perspective view of a prior art lower marine riser package similar to the lower marine riser package shown in FIG. 1.

FIGS. 1 and 2 are schematic illustrations, and LMRP 13 as shown in FIG. 2 appears slightly different; however, for the purposes concerned herein, they are the same. Referring also to FIG. 2, LMRP 13 is secured to a lower end of a riser 17 that extends up to a floating vessel or drilling platform at the sea surface. Riser 17 has a central main conduit through which strings of pipe are lowered into the well. Riser 17 also has auxiliary lines that connect to choke and kill lines 19 for circulating fluid to and from the BOP stack 11 below ram preventers 15. LMRP 13 has also control pods 21 supplied with hydraulic fluid pressure and electrical signals for controlling various components of LMRP 13 and BOP stack 11. LMRP 13 has one or more annular BOPs 23 (only one shown) that will close around pipe of a variety of sizes and also fully close in the event a pipe string is not extending through LMRP 13. A flex joint 25 connects an upper portion of LMRP 13 to riser 17. The lower of annular BOP 23 has an external flange for bolting to a hydraulically actuated connector 27 for connecting LMRP 13 to the upper end of BOP stack 11. In the event of an emergency and for maintenance reasons, a signal may be sent to control pod 21 to cause connector 27 to disconnect from BOP stack 11.

Figure 3:
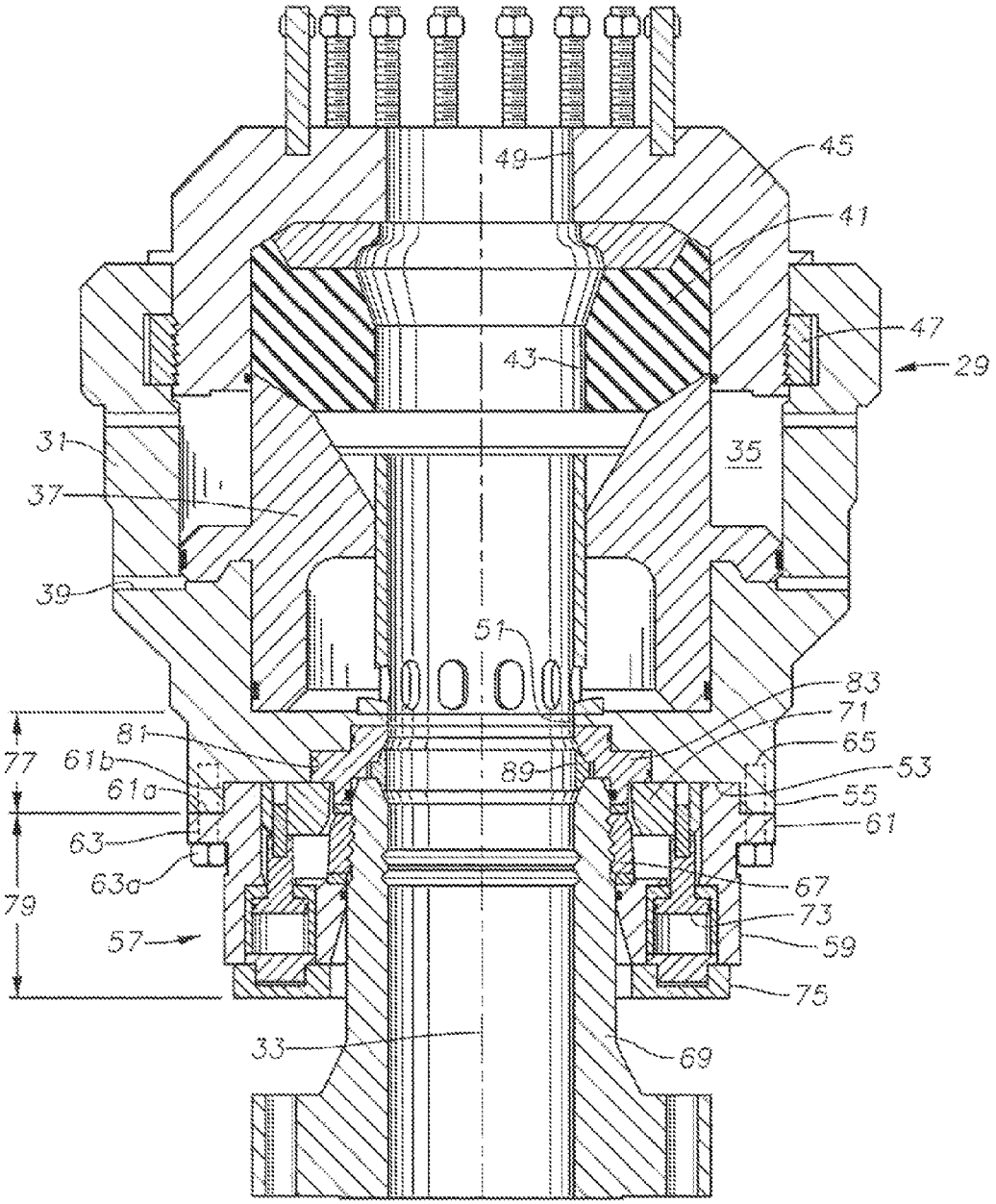
FIG. 3 is a vertical sectional view of an annular blowout preventer and connector constructed in accordance with this disclosure.

FIG. 3 illustrates an annular BOP 29 constructed is accordance with this disclosure. Annular BOP 29 has an annular element housing 31 that is a tubular, single-piece member. That is, annular element housing 31 is fabricated from a single piece of metal, not several components fastened together. Annular element housing 31 has a longitudinal axis 33 that passes concentrically through a central cavity 35. An annular element piston 37 is axially movable in central cavity 35 in response to hydraulic fluid pressure applied to central cavity 35 above and below annular element piston 37 via ports 39. An upper end portion of annular element piston 37 engages an elastomeric annular element 41, which has a central passage 43 through a string of pipe (not shown) is lowered. Upward movement of annular element piston 37 deforms annular element 41, causing central passage 43 to constrict and seal around a string of pipe. If no pipe is present, central passage 43 will fully close.

A cap 45 secures to the upper end of annular element housing 31 with a locking member 47. The upper end of annular element 41 engages a lower side of cap 45. Cap 45 has a concentric upper opening 49 with a diameter the same as the diameter of annular element passage 43 when annular element 41 is not being deformed. A concentric lower opening 51 is located at a lower end 53 of annular element housing 31 and is the same diameter as upper opening 49. Lower end 53 has at its outer periphery a downward extending cylindrical collar 55.

A connector 57 secures to annular BOP 29 for connecting to BOP stack 11 (FIG. 1). Connector 57 has a connector housing 59 that is also a single-piece member. Connector housing 59 has at its upper end an external flange 61 with an upward-facing surface 61*a*. Flange 61 defines an outward-facing cylindrical surface 61*b* a short distance inward from the outer diameter of flange 61. Flange upward-facing surface 61*a* directly contacts and abuts lower end 53 of annular element housing 31. More particularly, the lower end of collar 55, which is a part of lower end 53, abuts upward-facing surface 61*a*. The inner diameter of collar 55 engages outward-facing cylindrical surface 61*b*. Bolts 63 extend through holes in external flange 61 and into blind threaded holes 65 in annular element housing 31. Bolts 63 have heads 63*a* that abut the lower side of external flange 61 to secured connector housing 59 to annular element housing 31.

Connector 57 has a locking element, preferably a number of dogs 67 spaced circumferentially around connector 57. Dogs 67 have grooves on an inner side for engaging a grooved profile of a tubular mandrel 69 located at the upper end of BOP stack 11 (FIG. 1). An actuator element or cam ring 71 has an inner diameter that engages outer sides of dogs 67. Axial movement of cam ring 71 pushes dogs 67 radially inward to grip mandrel 69. One or more connector pistons 73 connect to cam ring 71 to cause axial movement of cam ring 71. A cap 75 secures to the lower end of connector housing 59.

Annular BOP 29 and connector 57 provide an assembly or unit with less height than similar components of the prior art. Axial distance 77 indicated in FIG. 3 is measured from the lower end of central cavity 35 to the lowest part of annular element housing lower end 53, which is at collar 55. Axial distance 79 is measured from lower end 53 at collar 55 to the lower end of connector housing 59. Axial distance 77 is less than axial distance 79. Also, there is no external bolt hole flange with an upward-facing surface located on a lower portion of annular element housing 31. Thus, the outer diameter of annular element housing 31 measured at any point from lower end 53 at collar 55 to the lower end of central cavity 35 is greater than or equal to the outer diameter at collar 55. The wall thickness of annular element housing 31 measured at any point from lower end 53 at collar 55 to the lower end of central cavity is greater than or equal to the wall thickness at collar 55.

Figure 4:
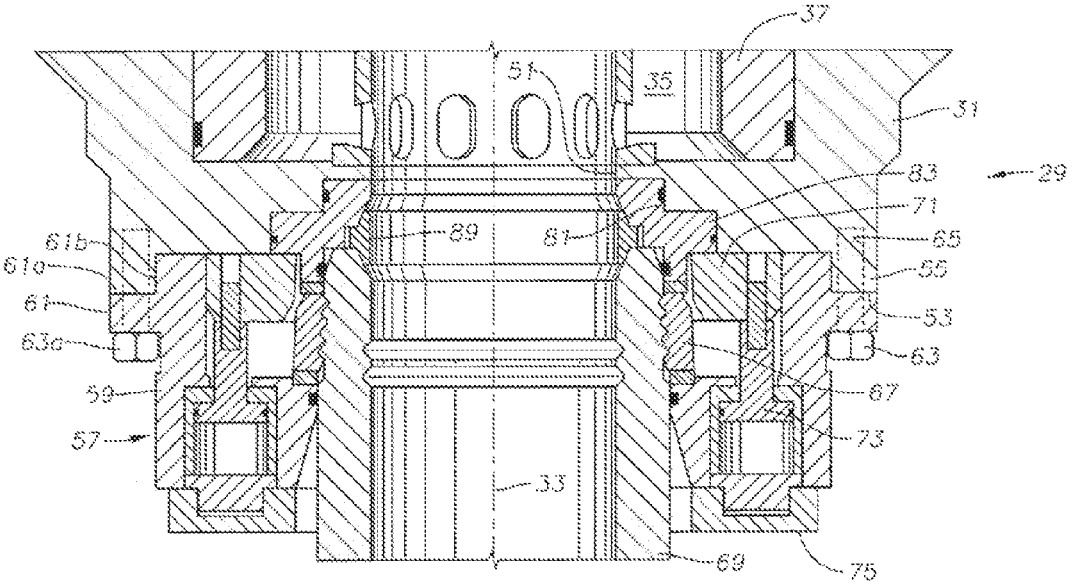
FIG. 4 is an enlarged vertical sectional view of a portion of the annular blowout preventer and connector of FIG. 3.
Figure 5:
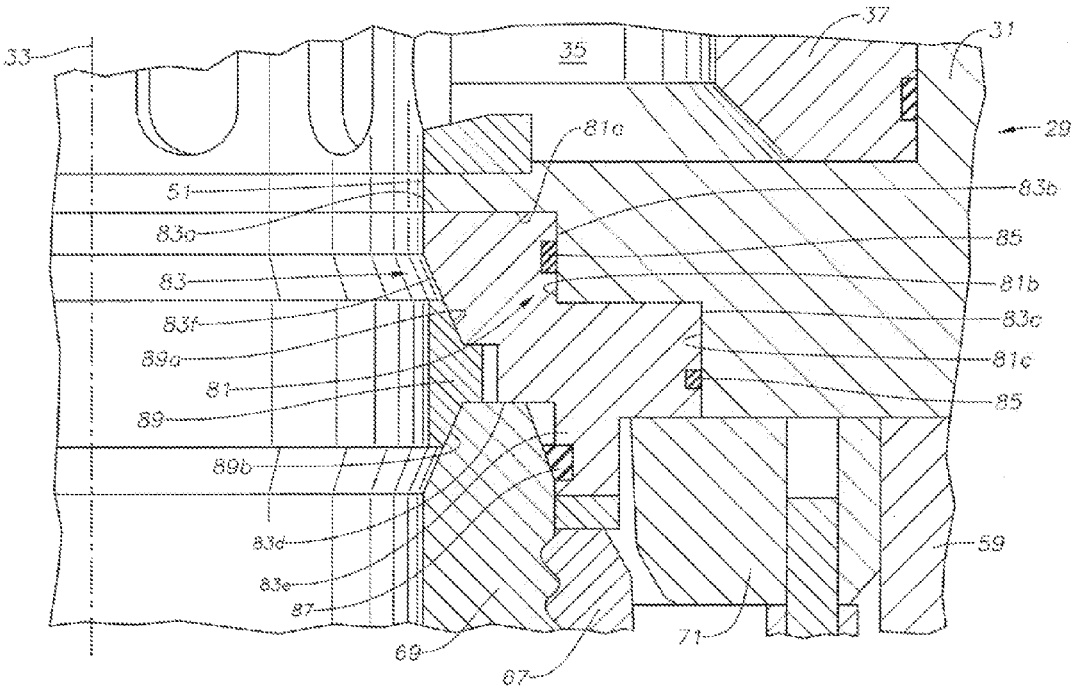
FIG. 5 is a further enlarged vertical sectional view of a portion of the annular blowout preventer and connector of FIG. 4.

Referring to FIGS. 4 and 5, a counterbore 81 is optionally formed in annular element housing 31 at lower opening 51. Counterbore 81 is directly below lower opening 51 and has a larger outer diameter. More specifically referring to FIG. 5, counterbore 81 has a downward-facing shoulder 81*a* and an upper outer diameter wall 81*b*. Counterbore 81 may also have a lower outer diameter wall 81*c* of greater diameter than upper outer diameter wall 81*b*.

A wear bushing 83 is optionally configured to fit closely in counterbore 81. Wear bushing 83 is a metal, sacrificial member that may suffer some damage from landing on BOP stack mandrel 69, but can readily be replaced when LMRP 13 (FIG. 2) is retrieved to the vessel. Wear bushing 53 has an upper end 83*a* that abuts downward-facing shoulder 81*a*. An upper outer cylindrical surface 83*b* engages counterbore upper outer diameter wall 81*b*. A lower outer cylindrical surface 83*c* engages counterbore lower outer diameter wall 81*c*. Wear bushing 83 has a lower end 83*d* that lands on the rim of mandrel 67.

Wear bushing 83 also has a cylindrical lower extension 83*e* that extends downward from lower end 83*d* into connector housing 59. Lower extension 83*e* has an outer diameter less than wear bushing outer surface 83*c* so that lower extension 83*e* will insert between cam ring 71 and mandrel 69. The portion of lower end 83*d* outward from lower extension 83*e* is closely spaced to or in substantial contact with the upper side of cam ring 71. The inner diameter of wear bushing 83 is the same as the inner diameter of opening 51 and has a downward-flaring tapered surface 83*f*.

Seals 85 are located on both the wear bushing cylindrical outer surfaces 83*b*, 83*c* for sealing to counterbore outer diameter walls 81*b* and 81*c*. Also, a seal 87 on the inner diameter of lower extension 83*e* seals to the outer surface of mandrel 69. A metal seal gasket 89 seals between wear bushing 83 and the inner diameter of mandrel 69. Seal gasket 89 has an upper tapered surface 89*a* on its outer side that seals to wear bushing tapered inner diameter portion 83*f*. Seal gasket 89 has a lower tapered surface 89*b* on its inner side that seals to a conical surface on the inner diameter of mandrel 69 near its rim. Seal gasket 89 is thus located in lower opening 51 of annular element housing 31 directly below central cavity 35.

Figure 6:
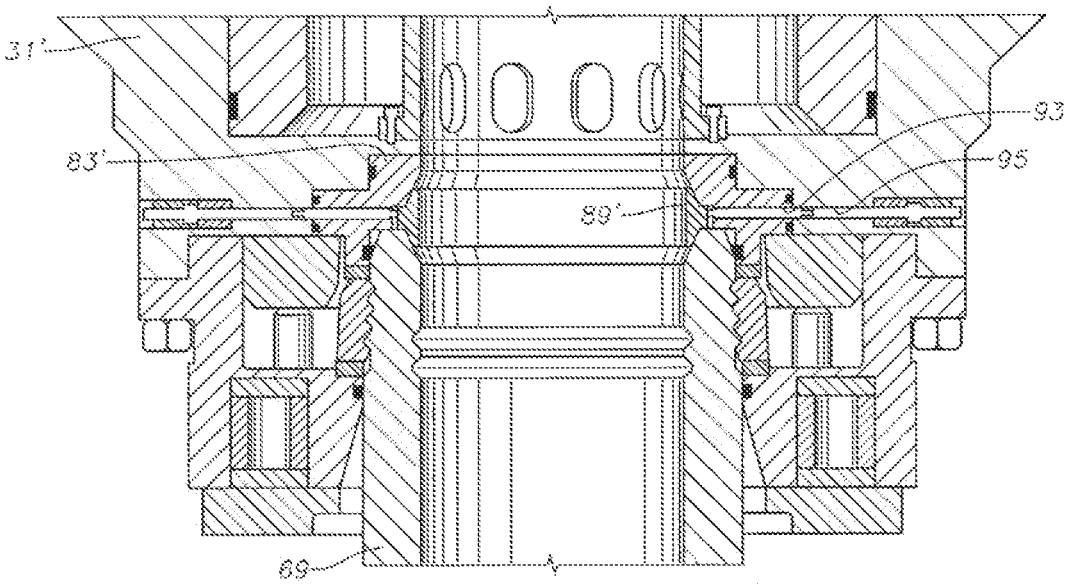
FIG. 6 is a sectional view of an alternate embodiment of a portion of the annular blowout preventer and connector of FIG. 3.

FIG. 6 illustrates an alternate embodiment of wear bushing 83, with other components remaining the same and not being discussed. Wear bushing 83' has a radially extending port 93 that is aligned with the external rib on seal gasket 89' between the upper and lower tapered seal surfaces. Port 93 is aligned with a test port 95 extending radially through annular element housing 31' to the exterior of annular element housing 31'. An operator may inject test pressure through test port 95 to determine whether seal gasket 89' is properly sealing to wear bushing 83' and mandrel 79.

In operation, connector 57 is secured to lower end 53 of annular element housing 31 by bolts 63. The operator lands LMRP 13 on mandrel 69 of BOP stack 11. Wear bushing 83 will land on the rim of mandrel 69. The operator supplies hydraulic fluid pressure to connector piston 73 to stroke cam ring 71 downward, which pushes dogs 67 radially inward into engagement with the exterior profile on mandrel 69. Once installed, the lower end of annular element housing collar 55 will be below the upper end of mandrel 69.

The disclosure has several advantages. By bolting connector housing 59 directly to the lower end 53 of annular element housing 31, an external flange with an upward-facing shoulder between the connector housing and the annular element housing is eliminated. The elimination of such a flange allows a reduction in overall height of the LMRP 13, which is an advantage when the LMRP 13 is positioned on the vessel for maintenance or transport. The sacrificial wear bushing 83 absorbs damage that might occur due to landing on the mandrel 69 of the BOP stack. If damaged significantly, the wear bushing can be replaced when the LMRP is retrieved.

While the disclosure has been shown in only two of its forms, it should be apparent to those skilled in the art that it is not so limited, but is susceptible to various changes without departing from the scope of the disclosure.

The invention claimed is:

1. An annular blowout preventer assembly, comprising:

an annular element housing having a central cavity containing an elastomeric annular element and an annular element piston that strokes axially, relative to an axis of the annular element housing, to deform the annular element radially;

a connector housing that abuts to a lower end of the annular element housing, the connector housing containing a locking element and a locking element piston, which axially strokes an actuator element to move the locking element radially inward into engagement with a mandrel of a blowout preventer stack;

a plurality bolts extending upward from the connector housing into threaded blind holes in the annular element housing for securing the connector housing to the annular element housing; wherein:

the annular element housing is a single-piece member;

the lower end of the annular element housing includes a depending collar at an outer diameter of the annular element housing; and the collar extends downward around an upper portion of the connector housing.

2. The blowout preventer assembly according to claim 1, further comprising:

a lower opening in the annular element housing; and a metal seal gasket carried within the lower opening for sealing between the annular element housing and the mandrel, the metal seal gasket being positioned at a higher elevation in the annular element housing than the lower end of the annular element housing.

3. The blowout preventer assembly according to claim 2, wherein the metal seal gasket has an inner diameter substantially the same as a minimum inner diameter of the lower opening.

4. The blowout preventer assembly according to claim 1, further comprising:

a lower opening in the annular element housing;

a metal seal gasket carried within the lower opening for sealing between the annular element housing and the annular element housing; and wherein a radial thickness of the annular element housing at any point from the seal gasket to the central cavity is at least equal to the radial thickness of the annular element housing at the seal gasket.

5. The blowout preventer assembly according to claim 1, wherein the annular element housing has an exterior surface from the lower end to the central cavity that is free of any upward-facing surfaces.

6. The blowout preventer assembly according to claim 1, wherein the connector housing is a single-piece member.

7. The blowout preventer assembly according to claim 1, wherein an axial distance from the central cavity to the lower end of the annular element housing is less than a distance from the lower end of the annular element housing to a lower end of the connector housing.

8. The blowout preventer assembly according to claim 1, further comprising:

an external flange on the connector housing, the external flange having an upper side that abuts the lower end of the annular element housing; and wherein the bolts extend through holes in the external flange and have heads that abut a lower side of the external flange.

9. A subsea annular blowout preventer assembly, comprising:

a blowout preventer stack having at an upper end a tubular mandrel with an exterior profile;

a lower marine riser package having an annular element housing with a central cavity containing an elastomeric annular element and an annular element piston that strokes axially, relative to an axis of the annular element housing, to deform the annular element radially around a string of pipe extending through the lower marine riser package;

the annular element housing having a lower end portion positioned below an upper end of the mandrel;

a connector housing containing a locking element and a locking element piston, which axially strokes an actuator element to move the locking element radially inward into engagement with the exterior profile on the mandrel;

an external flange on the connector housing, the external flange having an upper side that abuts the lower end portion of the annular element housing; and bolts extending through holes in the external flange into threaded holes in the lower end portion of the annular element housing to secure the connector housing to the annular element housing, the bolts having heads that abut a lower side of the external flange.

10. The blowout preventer according to claim 9, further comprising:

a metal seal gasket positioned in a lower opening of the annular element housing at an elevation above the lower end portion of the annular element housing.

11. The blowout preventer according to claim 9, wherein:

the lower end portion of the annular element housing comprises a depending collar having a lower surface that abuts the upper side of the external flange; and the collar has an inner diameter surface that engages an outer diameter surface on the connector housing.

* * * * *